US009227236B2

(12) United States Patent
Hermes et al.

(10) Patent No.: US 9,227,236 B2
(45) Date of Patent: Jan. 5, 2016

(54) METHOD AND DEVICE FOR PROFILE BENDING

(75) Inventors: Matthias Hermes, Lippstadt (DE); Matthias Kleiner, Dortmund (DE)

(73) Assignee: Universität Dortmund, Dortmund (DE)

( * ) Notice: Subject to any disclaimer, the term of this patent is extended or adjusted under 35 U.S.C. 154(b) by 739 days.

(21) Appl. No.: 12/532,041

(22) PCT Filed: Mar. 19, 2008

(86) PCT No.: PCT/EP2008/002171

§ 371 (c)(1), (2), (4) Date: Sep. 18, 2009

(87) PCT Pub. No.: WO2008/113562

PCT Pub. Date: Sep. 25, 2008

(65) Prior Publication Data

US 2010/0116012 A1 May 13, 2010

(30) Foreign Application Priority Data

Mar. 20, 2007 (DE) ..... 10 2007 013 902

(51) Int. Cl.
*B21D 7/08* (2006.01)

(52) U.S. Cl.
CPC ..... *B21D 7/08* (2013.01)

(58) Field of Classification Search
CPC ..... B21D 7/08
USPC ..... 72/152, 153, 166, 168, 169, 171, 172, 72/306, 307, 215, 217, 219, 226, 234, 251
See application file for complete search history.

(56) References Cited

U.S. PATENT DOCUMENTS 3,444,716 A * 5/1969 Martin ..... 72/135
4,367,641 A * 1/1983 Mizutani ..... 72/65

(Continued)

FOREIGN PATENT DOCUMENTS

DE 91 836 A 7/1896
DE 25 18 798 A1 11/1976

(Continued)

OTHER PUBLICATIONS

Rasi Maschinenbau GMBH, "Allies unter Kontrolle beim Rohrbiegen. Blech Rohre Profile", p. 40 ff. (Sep. 2002) (and English translation of the relevant passages attached).

(Continued)

*Primary Examiner* — David Bryant
*Assistant Examiner* — Lawrence Averick
(74) *Attorney, Agent, or Firm* — Panitch Schwarze Belisa & Nadel LLP

(57) ABSTRACT

A method and a device are provided for the planar and spatial bending of rod-shaped components (2) having a longitudinal axis, such as pipes and profiles, including two roller systems A and B that are disposed behind each other along the longitudinal axis, wherein the component is driven by the roller system A and inserted into the roller system B, and is bent by a movement of the roller system B in a transverse direction to the longitudinal axis of the rod-shaped components (2). A device is also provided for the planar and spatial bending of rod-shaped components (2) having a longitudinal axis, such as pipes and profiles, including two roller systems A and B, wherein feed along the longitudinal axis can be effected via the roller system A, and the roller systems A, B are disposed in at least one first plane E1 in a displaceable manner relative to each other, wherein at least one of the roller systems A, B can be pivoted about the longitudinal axis.

38 Claims, 9 Drawing Sheets

(56) References Cited

U.S. PATENT DOCUMENTS

| | | | | |
|---|---|---|---|---|
| 4,391,116 | A * | 7/1983 | Yogo | 72/168 |
| 4,878,369 | A * | 11/1989 | Apps et al. | 72/18.7 |
| 4,972,696 | A * | 11/1990 | Apps et al. | 72/16.2 |
| 5,014,533 | A * | 5/1991 | Anagnostopoulos | 72/131 |
| 5,309,746 | A * | 5/1994 | Abbey, III | 72/8.3 |
| 5,331,835 | A * | 7/1994 | Palma et al. | 72/224 |
| 5,425,257 | A | 6/1995 | Kitsukawa et al. | |
| 5,566,565 | A * | 10/1996 | Saegusa | 72/306 |
| 5,765,423 | A * | 6/1998 | Cattaneo et al. | 72/224 |
| 5,884,517 | A | 3/1999 | Yogo | |
| 6,041,635 | A * | 3/2000 | Cattaneo et al. | 72/235 |
| 6,116,071 | A * | 9/2000 | Cernuschi et al. | 72/224 |
| 6,253,595 | B1 * | 7/2001 | Lewis, Jr. | 72/369 |
| 6,276,182 | B1 * | 8/2001 | Cernuschi et al. | 72/224 |
| 6,279,363 | B1 * | 8/2001 | Averbuch et al. | 72/8.3 |
| 6,598,447 | B2 | 7/2003 | Meliga | |
| 6,954,679 | B1 * | 10/2005 | Takeda et al. | 700/165 |
| 2002/0104354 | A1 * | 8/2002 | Meliga | 72/166 |
| 2003/0029215 | A1 * | 2/2003 | Latour | 72/307 |
| 2005/0097935 | A1 * | 5/2005 | Gehrig et al. | 72/61 |
| 2005/0199033 | A1 | 9/2005 | Spaeth | |
| 2007/0074556 | A1 * | 4/2007 | Heatherington | 72/177 |
| 2008/0066517 | A1 * | 3/2008 | Tomizawa et al. | 72/364 |

FOREIGN PATENT DOCUMENTS

| | | | |
|---|---|---|---|
| DE | 196 30 025 | A1 | 1/1998 |
| DE | 197 17 232 | A1 | 10/1998 |
| DE | 199 56 796 | A1 | 6/2001 |
| DE | 101 19 030 | A1 | 1/2002 |
| DE | 600 00 994 | T2 | 9/2003 |
| DE | 102 14 275 | A1 | 10/2003 |
| EP | 1 087 278 | A2 | 3/2001 |
| EP | 1 857 195 | A1 | 11/2007 |
| JP | 04-266426 | A | 9/1992 |
| JP | 2007-301587 | A | 11/2007 |
| WO | 02/05982 | A1 | 1/2002 |
| WO | 2006/093006 | A1 | 9/2006 |

OTHER PUBLICATIONS

R. Neugebauer, et al, "Drossel W-G: 3D-Freiformbiegen von Profilen" ZGW, 11-12, pp. 611-615 (2001), (and English translation of the relevant passages attached).

Int'l Search Report issued on Jun. 13, 2008 in Int'l Application No. PCT/EP2008/002171.

Office Action Issued Jul. 6, 2007 in Germany Appln. U.S. Appl. No. PCT/EP2008/002171.

* cited by examiner

METHOD AND DEVICE FOR PROFILE BENDING

CROSS-REFERENCE TO RELATED APPLICATIONS

This application is a Section 371 of International Application No. PCT/EP2008/002171, filed Mar. 19, 2008, which was published in the German language on Sep. 25, 2008, under International Publication No. WO 2008/113562 A1 and the disclosure of which is incorporated herein by reference.

BACKGROUND OF THE INVENTION

The invention relates to a method and a device for the two-dimensional and three-dimensional bending of rod-shaped components, such as tubes and profiles, by a device comprising two roller systems A and B disposed behind each other along the longitudinal axis.

At present, machines being employed for the bending of tubes are, above all, mandrel bending machines (Franz, W.-D., *Maschinelles Rohrbiegen. Verfahren and Maschinen.* [Mechanical Tube Bending. Methods and Machines.], VDI-Verlag, ISBN 3-18-400814-2, 1988). In order to perform 3D bending of a tube in these machines, the tube to be bent is turned by twisting the tube cross-section, and is thereby moved into another bending plane, in which bending is then continued. This change from one bending plane to another results in 3D contours. However, this enables only invariable radii that are predetermined by the bending tool. Furthermore, with such machines it is not possible to produce 3D bends in profiles since when bending a profile, the required tool cross-section changes when the bending plane is changed, unlike with tubes having a circular cross-section.

Furthermore, so-called "free-formers" are known, which are likewise utilized only for tubes and are frequently built into mandrel bending machines as special tools (Rasi Maschinenbau GmbH., *Alles unter Kontrolle beim Rohrbiegen. Blech Rohre Profile* [Everything under Control with Tube Bending. Sheet Metal Tube Profiles], p. 40 ff (09.2002)). These "free-formers" operate according to the principle of roll forming, wherein the tubes are guided between at least 3 rolls in a plane. To change the bending plane, the tube must first be twisted between the rolls. Here again, the circular cross-section of tubes is very helpful. Using this principle, it is not possible to spatially bend non-circular profiles, since these get jammed in the bending rolls.

Furthermore, free-form bending machines have become known in recent years that work with sliding guides (Neugebauer R.; Blau P.; Drossel W-G., *3D-Freiformbiegen von Profilen.* [3D-Free-Form Bending of Profiles], ZWG, Nov. 12, 2001). Here, the tube or profile is pushed through corresponding guide bushes, which are offset relative to each other and which bend the profile in the process. A disadvantage here is that an additional, strong pusher is required and that the occurring large friction forces may damage the surface of the tube or profile. For this reason, as a rule, lubricants are being utilized in these machines, which have to be laboriously removed from the workpiece after the working. An additional disadvantage is that fitting bushes need to be manufactured for each type of profile, which bushes, due to the high contact pressures per unit area, consist of expensive ceramic materials. In these free-form bending machines, the spatial direction in which the profile emerges from the machine is always dependent on the contour of the bent component. For this reason, complex multi-axis kinematics of the guide bushes is necessary in order to exactly reproduce the spatial curve of the bent component at that location, making such a free-form bending machine very complex and expensive. In addition, if it is desired to measure the profile during the process at the outlet of the machine (e.g., for control purposes) this will require a complex sensor system that is capable of recording 3D coordinates.

All systems that are currently being used utilize a relatively complex pusher that pushes the profile positively via the longitudinal axis. Here, the profile has to be guided in a relatively elaborate manner to prevent the profile from buckling induced by the thrust load. This is furthermore disadvantageous because the pusher puts a limit on the total length of the tubes and profiles that can be worked.

BRIEF SUMMARY OF THE INVENTION

Hence, it is the object of the present invention to provide a method and a device by which any desired rod-shaped components can be bent two-dimensionally or three-dimensionally. More particularly, in addition to circular tubes, it is also possible with this method or device to bend any desired profiles two-dimensionally or three-dimensionally, while the total length of the tubes or profiles is not limited by the configuration of the inventive device.

One aspect of the invention relates to a method for bending rod-shaped components having a longitudinal axis, such as tubes and profiles, wherein the feed of the tube or profile through the machine is effected by frictional engagement by a first roller system A, i.e. the transport rollers. At the outlet of the machine, there is disposed a second roller system B, the bending rollers. Using the roller system A as a drive, canting or distortion of the component between a pusher and bending bushes, as frequently occurring in known devices, are prevented. By feeding in parallel to the longitudinal axis in the roller system A, a forming zone is discretely fixed between the roller systems A and B. Interactions between stresses applied across the entire component, and the associated fluctuations in forming, can no longer occur in the method according to the invention.

The rollers of the roller system A may be disposed in a plane, or they may be arranged distributed around the cross-section of the tube or profile, enclosing the cross-section partially or completely. Application of force is effected via several rollers resting on the component side by side and/or one after the other. By the contact pressure which is uniformly applied across the rollers, an at least partially enclosing hold parallel to the longitudinal axis is achieved, safely maintaining the contact pressure below the plastic range.

It continues to be possible to exert a force on the tube or profile by the rollers that acts essentially perpendicularly to the longitudinal axis of the tube or profile in order to enhance frictional feed. The rollers may be profiled and/or have a coating that optimises frictional contact. By roller profiles, which are elastically pressed onto the component surface, the holding force of the roller system A is advantageously increased. Through elastic coatings, the contact pressure is distributed more uniformly, and plastic deformation of the component in the roller system A in the case of superposed shearing forces, is safely prevented in a preferred manner. Such coating may consist of a polymer. In a particularly advantageous embodiment, this coating consists of a layer of an elastomer applied by vulcanisation. Using a roller system A with a contact pressure that can be adjusted in a controlled manner, components of varying wall thickness or made from various materials of different elasticity can be fed to the roller system B with the holding force being adjusted dependent on the given section and component. Plastic deformation in the roller system A is thereby safely prevented, and the forming in the region of the forming zone always yields the same results.

By the constant feed effected by the roller system A, it is possible to provide bent components at a constant production rate. This fabrication can especially advantageously be integrated in clocked, continuous production flows. By the roller drive system, components of any length can be fed at a constant rate.

At the outlet of the machine there is located the second roller system B, i.e. the bending rollers. This roller system B consists of rollers that are arranged pairwise around the circumference of the tube or profile. The entire roller system B is disposed on an independent support system and is movable in at least one plane relative to the roller system A. Bending of the tube or profile is effected by changing the position of the roller systems A and B relative to each other while the tube or profile is being transported through the roller systems.

By oppositely arranged roller surfaces in the system B, a transverse force is applied preferably uniformly across the component cross-section. A small-area bearing, ideally in the shape of a point or transverse line, of the rollers on the component surface, ensures a tangential bearing of the roller system B on the component. Rollers having a larger bearing surface are made to follow up during the bending in an orientation of their bearing surface that is tangential to the component surface. Canting of the component between the roller systems A and B is thereby safely prevented.

Movability of the roller system B along one axis already enables bending of 2D contours. Plane, e.g. S-shaped, contours can be produced by appropriate positioning of the roller system B relative to the fixed roller system A.

In an advantageous embodiment, the roller systems enclosing the rod-shaped components comprise adjusting mechanisms. This enables the working of tubes and profiles having different cross-sections. In this way, the roller systems can be adjusted to components having asymmetrically profiled sections of deviant cross-sections, for example by rollers whose distance to the longitudinal axis can be adjusted for each roller. Adjusting the roller systems to the changed component cross-section, it is possible to bend such structured sections directly, section by section, without a time-consuming replacement of the rolls. Furthermore, the contact pressure of the rolls can thereby be adjusted to ensure frictional transport in the roller system A. The rollers of the roller system B are preferably adjusted to a low friction coefficient which additionally facilitates the sliding of the component along the bearing surfaces of the rollers, which bearing surfaces are preferably guided tangentially.

In another advantageous embodiment, the rollers of the roller system B are likewise drivable. Driving the component is performed at an angle $\alpha$ to the longitudinal axis of the rod-shaped component. Via frictional contact in the roller bearing surfaces, additional tensile stress or compressive stress can be superposed in the region of the forming zone between the roller systems by increasing or reducing the forward movement of the roller system B.

By additionally superposed stresses, it is possible to compensate spring-back and elastic deformation already during the bending operation. In this way, the desired forming can be obtained in only one forming process, without time-consuming reworking. It is thus possible to bend, in particular, profiled components in a manner true to shape, while maintaining the component cross-section, and without bucklings.

In another advantageous embodiment, the roller system B is pivotable in a further plane through a rotation angle $\beta$, the further plane being oriented at right angles to the first plane. On moving the roller system, the rotation angle $\beta$ is varied in such a way that the bearing surfaces of the rollers are guided tangentially to the component surface. By the additional pivoting, a torsional stress can be superposed on the formation zone to achieve the above-described compensation.

In a further advantageous embodiment, the roller systems A and/or B are each pivotable about the longitudinal axis of the profile by appropriate rotation mechanisms. It is thereby possible to pivot the bending plane about the longitudinal axis of the profile during the bending process, whereby a third plane can be manipulated and 3D-curved components can be produced. Hence, if the roller systems are sufficiently pivotable, any possible spatial curves can be produced. In the instant embodiment, this means that by using only two driven axles it is possible to produce bends in all three spatial directions. The first axle moves the roller system at the outlet of the machine and thus generates the bend in the profile. The second axle permits a change of the bending planes by pivoting the roller systems A and B, and thereby permits the bending of 3D contours. This is advantageous in comparison with the free formers of the state of the art, which, having many axes that need to be moved synchronously, are much more complex. By pivoting the roller systems relative to each other, an additional torsional stress can be superposed during the forming operation in order to achieve the above-described compensation.

It is an advantage in this device that, by contrast to the above described free-form bending machines, the profile always emerges from the roller system in only one plane with respect to the machine. To measure the profile during the process, relatively simple systems, which record only 2D-coordinates, are therefore sufficient. If the position of the last roller pair is recorded, in which it is ensured that the profile emerges tangentially from the system, it will even be sufficient to make a 1D measurement of the emerging profile to record the complete contour.

In another advantageous embodiment, the recorded data are returned to the control unit of the machine and thus enable a controlled process that compensates the fluctuations in the bending behaviour of the semi-finished products with regard to a more precise contour. In accordance with the invention it is particularly advantageous if characteristic relationships between the set values of the machine axes and the result of bending are stored in a database and are taken into account by the control program during operation.

The corresponding fundamentals of the relations between the setting values of the machine axes for the closed-loop control of profile bending processes are shown in the dissertation by S. Chatti, "Optimierung der Fertigungsgenauigkeit beim Profilbiegen" [Optimizing the Manufacturing Accuracy in Profile Bending], Dr. Ing. Dissertation, Universität Dortmund, Shaker Verlag Aachen (1998).

In another advantageous embodiment, a torsional moment is introduced in the bending zone between the roller system A and the roller system B in the device according to the present invention. It is thereby possible, for example, to reduce the bending forces or, in the case of asymmetric profile cross-sections, to counteract the unwanted torsion through the superposition of a torsional stress. In this way, it is possible to achieve a forming that is true to shape, especially with profiled components. To this end, the machine's rotational axis about the longitudinal axis of the profile is set at different angles in the discharge roller system and in the other roller systems. This may be done, as with all the movable axes of the machine, by manual or NC control of the drive axles, which may be an electronic-type or hydraulic-type control.

In another advantageous embodiment, a mandrel system is mounted at the rear part of the device at which the profile is introduced into the process as a semi-finished product, which mandrel system holds a mandrel, e.g. being of an articulated mandrel-type, in the forming zone of the process, thereby reducing the occurrence of cross-section deformations which may occur, for example, in hollow profiles.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
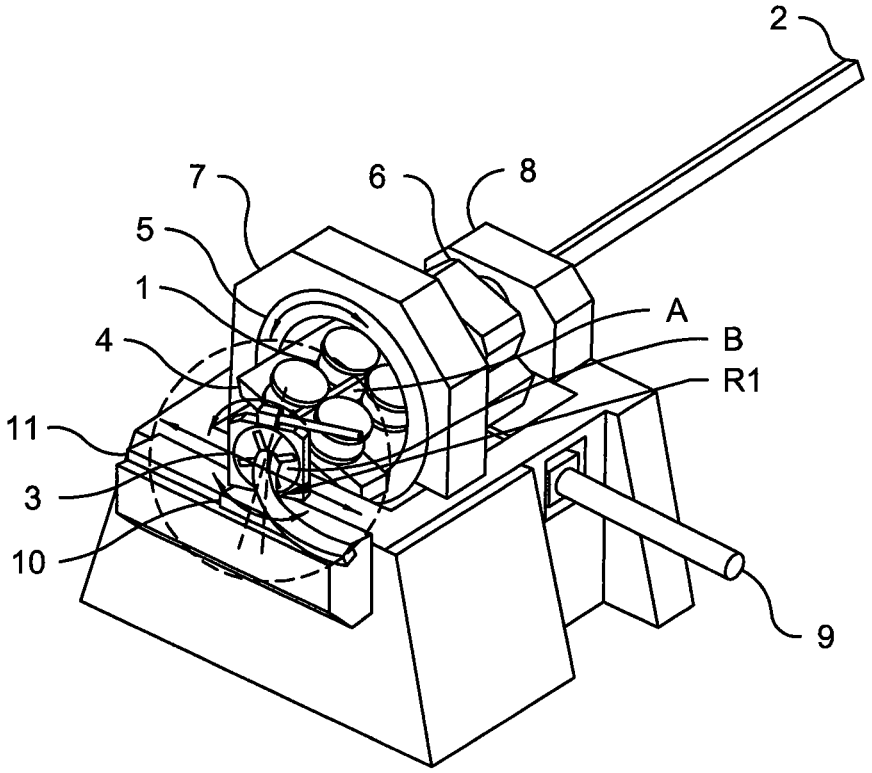
FIG. 1 is an overall, perspective view of a device according to an embodiment of the invention with a clamped profile during bending in a first plane with radius R1.
Figure 1A:
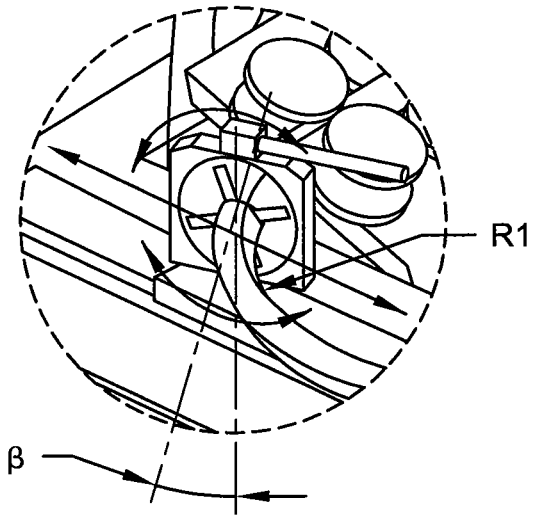
FIG. 1A is an enlarged detail view of the roller system B according to the dashed circle section of FIG. 1.

FIG. 1 shows an example of an embodiment of the invention. In this figure, three profiled roller pairs 1 have been arranged one behind the other for axial drive of the profile 2. These roller pairs are arranged on a casing 4, in which are integrated the corresponding drive for all rollers and a mechanism for adjustment and pressuring the roller pairs. On the casing 4 there are mounted the ring 5 and the shaft stub 6, which enable a rotation of the entire casing in the bearing cases 7 and 8. This rotary motion is brought about in this embodiment by a hydraulic cylinder 9, which in the instant case allows for a rotation through a total of 90 degrees; a rotary drive (of electric or hydraulic type), which would enable a complete 360 degree rotation, is however conceivable as well. By this rotary motion and the completely enclosed profile, the profile can be rotated about the longitudinal axis during the bending process.

The roller system 3, which is located at the outlet of the machine, is constructed like a die and encloses the profile cross-section on four sides by bending rollers 3*a, b, c, d*. When the profile type is changed, the roller system can additionally be radially adjusted to the respective profile type. In this embodiment, this system is also capable of performing the rotation about the longitudinal axis of the profile to be bent, and it is likewise driven. It is thereby possible in this embodiment to introduce a torsional moment into the process, in addition to the change of bending plane, providing the above-mentioned advantages. An additional rotation axis that is perpendicular to the longitudinal axis of the profile is required and the rotation angle β is varied in such a way to ensure that the roller assembly is tangential when changes in bend radius occur. The formation of bending radii R1 is achieved by moving the sliding carriage 10 along the longitudinal axis 11, which carriage produces the bending radius via its relative position.

Figure 2:
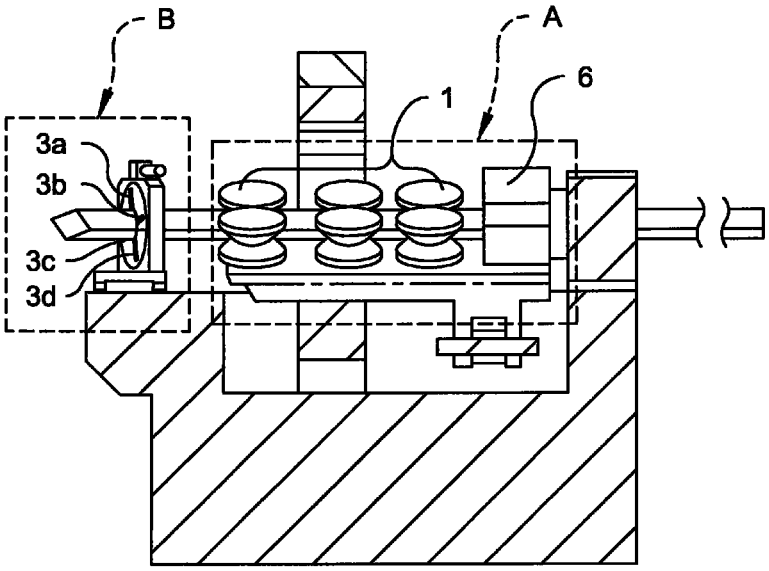
FIG. 2 is a longitudinal section of the bending device taken along cutting line II-II in FIG. 3, wherein the assembly groups of the two roller systems A and B have been marked off.

FIG. 2 is a sectional drawing of the embodiment according to FIG. 1. The assembly group comprising the transport rollers 1 is here denoted by A, and the complete assembly group comprising the bending rollers 3*a*, 3*b*, 3*c*, 3*d* is denoted by B.

Figure 3:
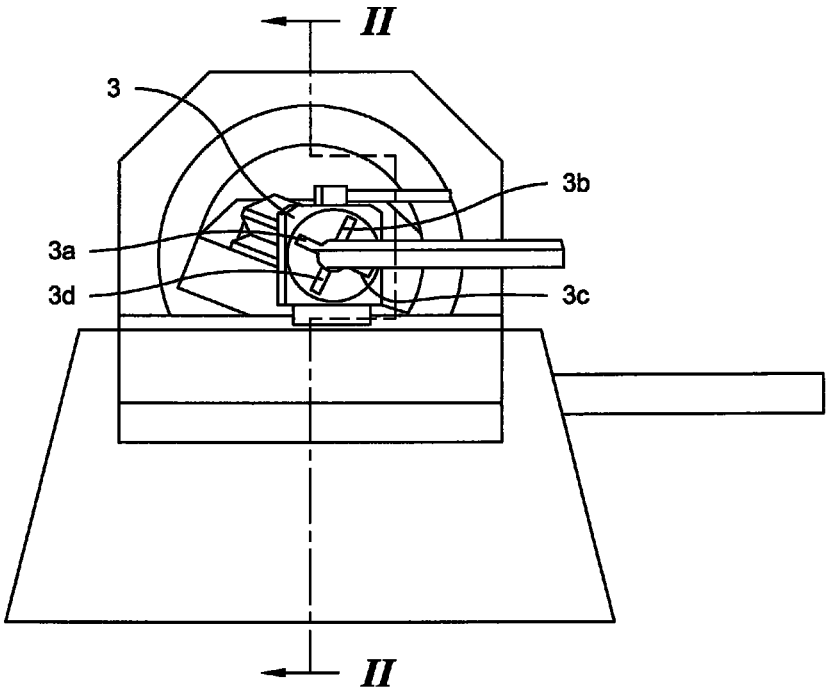
FIG. 3 is a front view of the device during bending in one plane, showing the cutting line for the section of FIG. 2.
Figure 4:
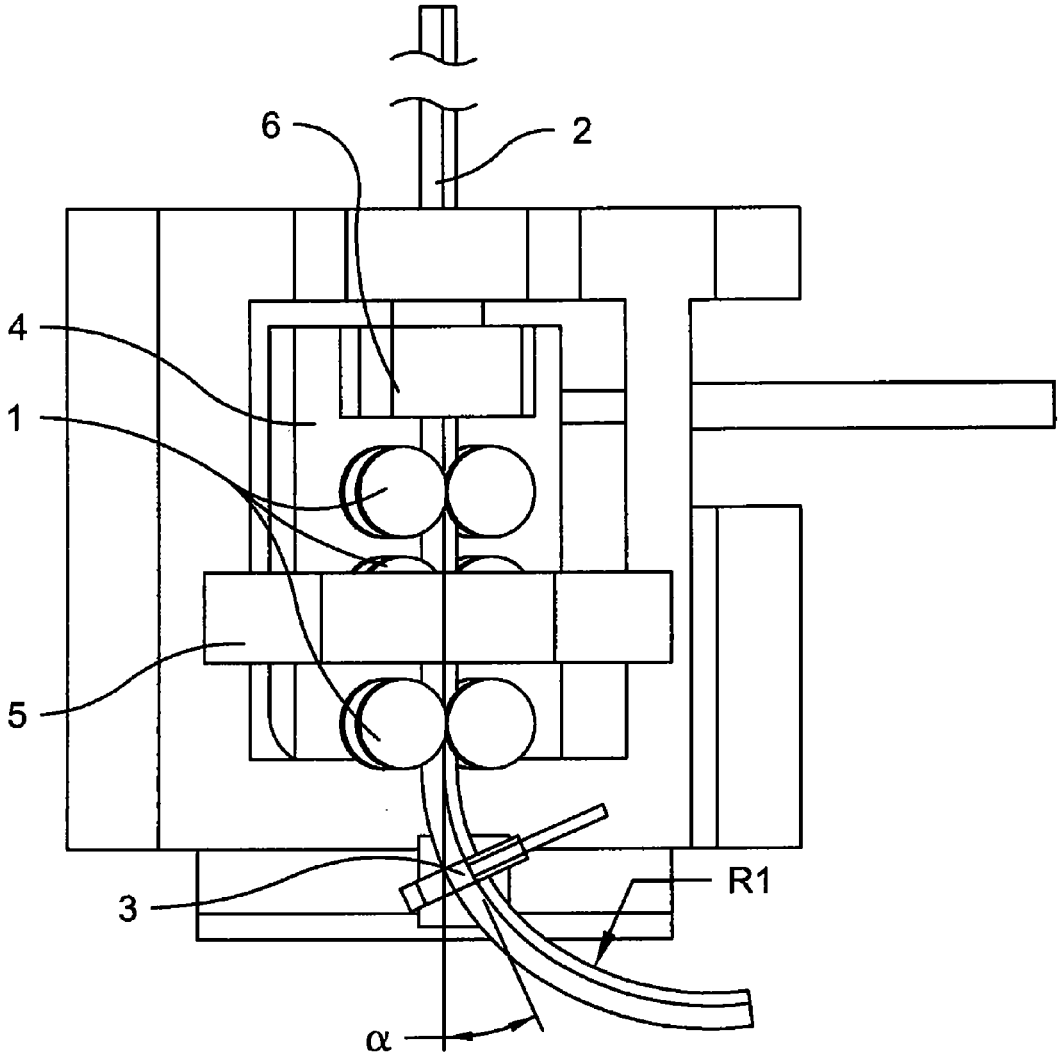
FIG. 4 is a plan view of the device during bending in one plane.

FIG. 3 is a front view of the device, wherein the cutting line II-II for the section of FIG. 2 has been marked, comprising the bending rollers 3*a*, 3*b*, 3*c*, 3*d*. FIG. 4 shows a plan view of the system wherein the machine setting of the assembly of bending rollers for bending a left-hand bend having the radius R1 and the angle α are marked.

Figure 5:
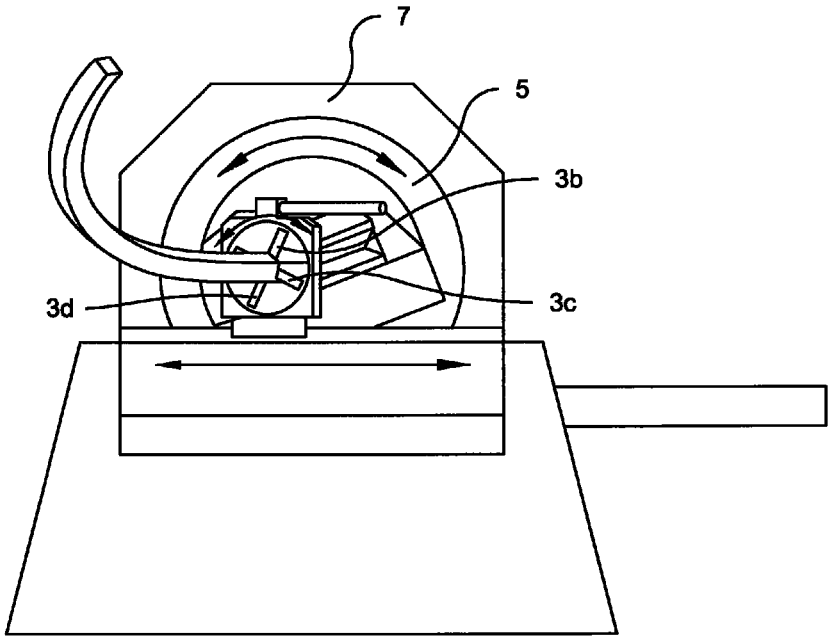
FIG. 5 is a front view of the bending device during a change of bending plane by pivoting the roller systems A and B with a simultaneous change of bending direction.
Figure 6:
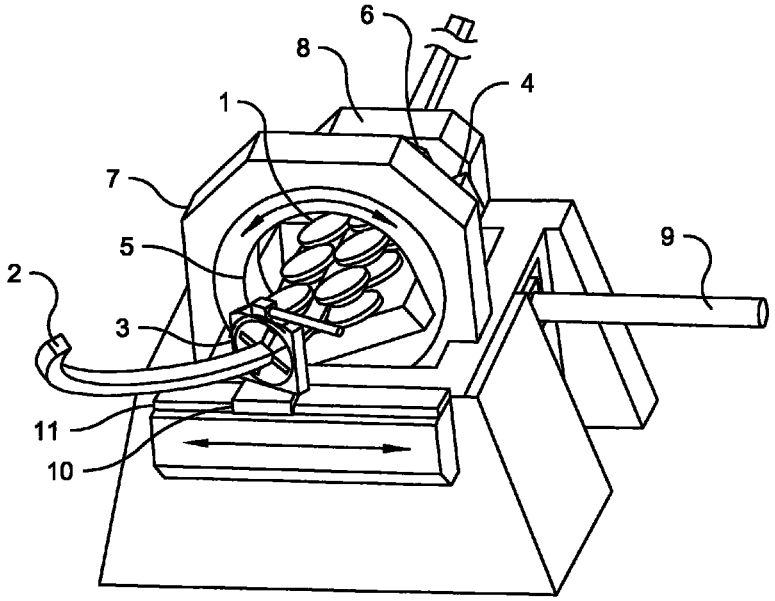
FIG. 6 is a perspective front view showing the change of bending plane by pivoting the roller systems A and B and the change of bending direction.
Figure 7:
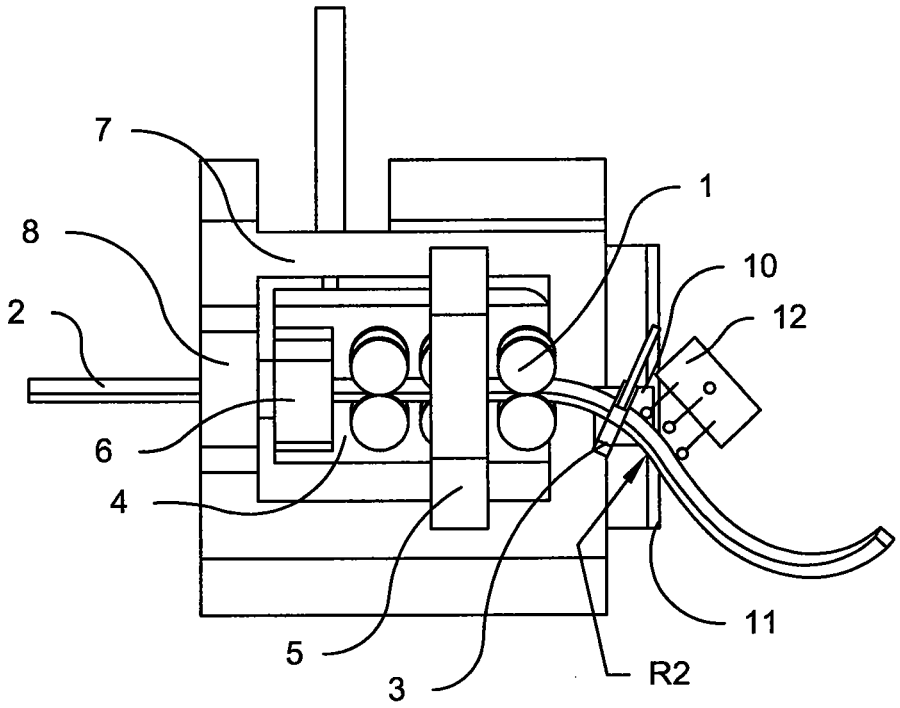
FIG. 7 is a plan view of a device comprising a tactile contour sensor and showing a change of bending plane.

In FIGS. 5, 6 and 7, a change of bending plane is illustrated. By pivoting the roller systems A and B, that is the bending rollers 3*a*, 3*b*, 3*c*, 3*d* and the ring 5 for the roller pairs 1, a new radius R2 in a new bending direction and bending plane is bent in the profile 2, which profile is thereby also twisted about its longitudinal axis. Furthermore, by way of example, a tactile contour sensor 12 is mounted at the outlet of the roller in FIG. 7, which contour sensor follows the bends with a roller and measures the profile during the process. This enables a correction of the setting parameters for setting the machine axes to arrive at the required bending contour.

As an extension of and complementary to the object of bending any desired rod-shaped components two-dimensionally or three-dimensionally, with the device and method according to the invention it is also possible to determine profile-specific material properties and to use the data derived therefrom for a precise process simulation and improved process planning. This is advantageously effected through the fact that sensors for measuring the forces and moments occurring when the profile is being bent and twisted are arranged in the roller pairs A and/or B. From this, and, if applicable, in combination with the data previously determined by the aforementioned contour sensor, it is possible to determine the profile-specific material data required for a process simulation or improved process planning, by commonly used programs. As an example for the process simulation by commonly used programs, reference is made to the following publication: Dirksen, U.; Chatti, S.; Kleiner, M., "Closed-loop Control System for the Three-roll-bending Process Based on Methods of Computational Intelligence," *Proceedings of the 8th International Conference on Technology of Plasticity* (2005).

Figure 8:
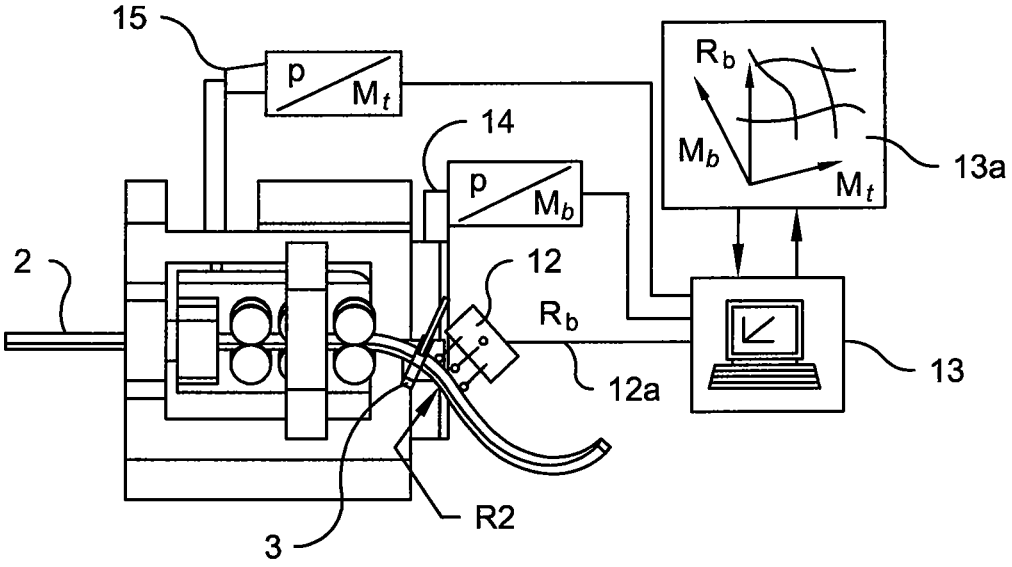
FIG. 8 is a schematic diagram of a basic configuration for the closed-loop control of a bending process.

To illustrate the setup of a sensor system, a process-planning tool is depicted schematically, as a block diagram, in FIG. 8. After the profile 2 has left the roller system 3, its bend contour is recorded via the contour sensor 12 while the bend radius $R_b$ is inputted into a process control computer 13 via line 12*a*. Furthermore, the bending moment transmitter 14, disposed at the sliding carriage 10, for determining the bending moment $M_b$, is connected to the process control computer 13. Together with the torsional moment $M_t$ received from the torsion moment transmitter 15, the process data are used in the process computer 13 for a precise process simulation 13*a* and an improved process planning. Hence, the complete device may be referred to as a process planning tool by which two-dimensional or three-dimensional bending can be optimized in terms of process engineering.

An additional extension and improvement of the device according to the invention is made possible by using a special cutting tool for flying cut-off. This supplementary device is particularly useful for applications where very long semi-finished parts (profile 2, in the example) are used or where profiles manufactured from a coil are worked.

Figure 9:
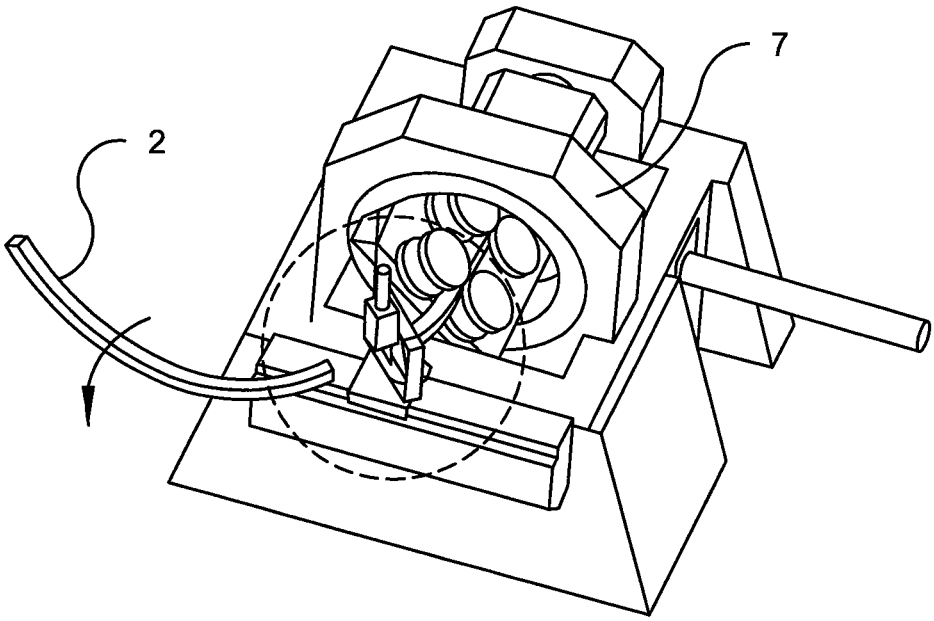
FIG. 9 is an overall, perspective view a bending device according to another embodiment of the invention, comprising a cutting tool extension for flying cut-off.
Figure 9A:
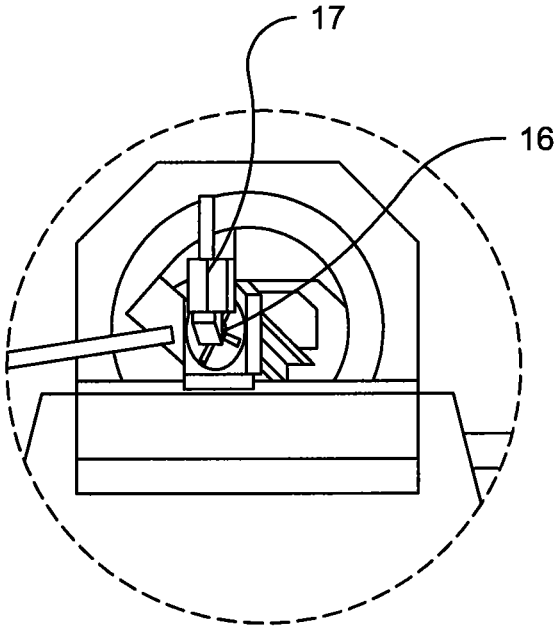
FIG. 9A is an enlarged view of the dashed circle section of FIG. 9.

FIG. 9 shows such a cutting tool for flying cut-off, which is mounted at the end of the device according to an embodiment of the invention in the region of the bending rollers 3*a, b, c, d* of the roller systems 3. As a consequence, it is possible, after the bent part or the bent profile system 2 has been manufactured, to cut off the beam or a certain length of profile and thereby to provide a bent component that is formed true to contour in all dimensions.

As a matter of course, the cutting tool represented in FIG. 9 for flying cut-off is to be regarded as a solution by way of example. The movement of the extendable cutting knife 16 is induced via a hydraulic cutting cylinder 17. The cutting tool can, however, be realized not only in the form of a shearing cut, but also in the form of a cutting tool with a rotating tool movement, acting on several sides, or by a chip-removing or thermal cutting process. It is advantageous that the orientation of the cutting tool is always carried along tangentially to the profile contour. In addition, the fixed installation at the end of the bending device is useful as it enables a flying cut-off during the process without complex guiding devices.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for planar and spatial bending of a rod-shaped component having a longitudinal axis using a device having first and second roller systems (A and B) disposed along the longitudinal axis, wherein said first roller system (A) comprises a plurality of transport rollers and said second roller system (B) comprises a plurality of bending rollers, the method comprising steps of:

driving the rod-shaped component by the first roller system (A) to insert the rod-shaped component into the second roller system (B) and to transport the rod-shaped component through the first and second roller systems (A and B), moving the second roller system (B) in a transverse direction to the longitudinal axis of the rod-shaped component, and thereby changing a position of the first and second roller systems (A and B) relative to each other while the rod-shaped component is being transported by the first roller system (A) through the first and second roller systems (A and B), to bend the rod-shaped component within a bending zone between the first and second roller systems (A and B), and pivoting the roller system (A) relative to the roller system (B) about the longitudinal axis of the rod-shaped component, and thereby superposing torsional moments on the bending zone between the first and second roller systems (A and B) during the bending of the rod shaped component.

2. The method according to claim 1, wherein the first roller system (A) comprises pairwise-opposite rollers which can be separately adjusted in relation to their distance to the longitudinal axis and which are drivable, wherein the rollers of the first roller system (A) partially or completely enclose the component in at least one cross-sectional plane, and wherein during continuous feed the component is twisted about the longitudinal axis by pivoting the first roller system (A) about the longitudinal axis in a first plane (E1).

3. The method according to claim 1, wherein the component is guided via the second roller system (B) comprising roller pressing surfaces bearing against the component at opposite sides, and wherein by transverse displacement of the second roller system (B) relative to the longitudinal axis and simultaneous pivoting about a center axis of the second roller system (B) perpendicular to the longitudinal axis, the bending of the component with a controlled bending contour is effected.

4. The method according to claim 3, wherein when changes in radii of the bending occur, the roller pressing surfaces of the second roller system (B) are each tangentially adjusted to the component surface.

5. The method according to claim 1, further comprising a step of pressing the rollers of the first and second roller systems (A and B) perpendicularly to the longitudinal axis of the component, to adjust contact pressure between the component and the rollers, such that frictional contact between the component and the rollers of the first and second roller systems (A and B) is adjusted in a defined manner.

6. The method according to claim 1, wherein the second roller system (B) is configured to be pivotable relative to the longitudinal axis of the component and is simultaneously displaced, relative to the first roller system (A), in two further spatial axes, with the component being fed out perpendicularly to a plane defined by the second roller system (B), at a constant rate.

7. The method according to claim 1, wherein the driving step comprises feeding the component via the first roller system (A) in a direction of the longitudinal axis, and driving the component via the second roller system (B) at an angle ($\alpha$) to the longitudinal axis of the rod-shaped component.

8. The method according to claim 2, wherein during continuous feed the second roller system (B) is pivoted in at least one further plane oriented perpendicular to the first plane (E1), with a rotation angle ($\beta$) being varied during the bending by moving the second roller system (B) in such a way that the rollers are pressed on tangentially to a component surface.

9. The method according to claim 1, wherein a change of bending planes is effected by a transverse displacement and simultaneous pivoting of the first and second roller systems (A and B) relative to each other about the respective longitudinal axis.

10. The method according to claim 1, wherein via a contour sensor the bending of the component is followed at an outlet of the second roller system (B), and wherein if a deviation from a desired contour occurs, setting parameters ($\alpha$, $\beta$) and the transverse displacement of roller pairs of the first and second roller systems (A and B) are adjusted such that a compensation of the deviation measured by the contour sensor occurs.

11. The method according to claim 10, wherein, in roller pairs of at least one of the first and second roller systems (A and B) forces and moments occurring during the bending are measured independently by sensors arranged in at least one of the first roller system (A) and the second roller system (B), and profile-specific material properties are derived therefrom which are used for a precise process simulation and improved process planning.

12. The method according to claim 11, wherein data received from the contour sensor are stored and are processed, together with the forces and moments that have been measured on the roller pairs.

13. The method according to claim 1, wherein the first roller system (A) produces a feed in a direction along the longitudinal axis, and the second roller system (B) performs a movement in a direction transverse to the longitudinal axis of the rod-shaped component, wherein during continuous feed of the component along the longitudinal axis via the first roller system (A), bending in a first plane is adjusted by positioning the first and second roller systems (A and B) relative to each other in the first plane, and wherein bending or twisting in at least one further plane is adjusted by pivoting the first and second roller systems (A and B) relative to each other and about a respective position of the longitudinal axis or a transverse axis in the rod-shaped component.

14. The method according to claim 1, wherein a contour of a bent component is recorded by at least one sensor, is converted into data, and the data are fed to a control unit comprising a correction program for machine setting.

15. The method according to claim 1, wherein the rod-shaped component is frictionally driven and guided in the first roller system (A) by rollers.

16. The method according to claim 1, wherein the rod-shaped component is driven in the second roller system (B) via roller contact surfaces arranged opposite each other.

17. The method according to claim 1, wherein the rod-shaped component is driven in the second roller system (B) via roller contact surfaces arranged opposite to each other, and wherein by increasing or reducing forward driving movement via the second roller system (B), the rod-shaped component is subjected to a controlled tensile or compressive stress in the bending zone between the first and second roller systems (A and B) during the bending.

18. The method according to claim 1, wherein a controlled torsional stress is superposed on the component in addition to bending stress.

19. A device for planar and spatial bending of a rod-shaped component having a longitudinal axis, comprising:

at least first and second roller systems (A and B) disposed along the longitudinal axis of the rod-shaped component, said first roller system (A) comprising a plurality of transport rollers and said second roller system (B) comprising a plurality of bending rollers, wherein feed of the rod-shaped component along the longitudinal axis is produced by engagement between the transport rollers of the first roller system (A) and the rod-shaped component, wherein the first and second roller systems (A and B) are disposed in at least one first plane (E1) in a displaceable manner relative to each other, wherein at least the first roller system (A) is pivotable about the longitudinal axis of the rod-shaped component, and wherein, for bending the rod-shaped component, the position of the first and second roller systems (A and B) relative to each other is configured to be changed while the rod-shaped component is conveyed through the first and second roller systems (A and B).

20. The device according to claim 19, further comprising sensors for forces and moments occurring when the rod-shaped component is being bent and twisted are disposed in at least one of the first and second roller systems (A and B).

21. The device according to claim 19, further comprising a contour sensor for following a bend in the rod-shaped component, the sensor being disposed at an outlet of the second roller system (B).

22. The device according to claim 20, wherein the sensors are connected to each other via a process control computer to determine profile-specific material properties and for precise process simulation and improved process planning.

23. The device according to claim 19, wherein the first and second roller systems (A and B) are movable independently of each other on a plurality of axes in space or on at least one plane.

24. The device according to claim 19, wherein rotation angles of drive axles of the first and second roller systems (A and B) are separately adjustable.

25. The device according to claim 24, wherein the drive axles are adjustable manually, electronically or hydraulically by numerical control.

26. The device according to claim 19, wherein a guide path of the rod-shaped component ends immediately behind a last roller system, in a spatially fixed plane.

27. The device according to claim 19, wherein the first and second roller systems (A and B) comprise a mechanism by which a roller position is adjustable to varying component cross-sections.

28. The device according to claim 19, wherein individual rollers or all rollers of the first and second roller systems (A and B) are profiled.

29. The device according to claim 19, wherein individual rollers or all rollers of the first and second roller systems (A and B) have a friction-optimized coating.

30. The device according to claim 29, wherein the coating comprises a polymer, optionally an elastomer.

31. A method for planar and spatial bending of a rod-shaped component having a longitudinal axis using a device having first and second roller systems (A and B) disposed along the longitudinal axis, each roller system including a plurality of rollers, the method comprising:

driving the rod-shaped component by the first roller system (A) to insert the rod-shaped component into the second roller system (B), driving the rod-shaped component forward by driving rollers of the second roller system (B) via roller contact surfaces arranged opposite each other, moving the second roller system (B) in a transverse direction to the longitudinal axis, thereby changing a position of the first and second roller systems (A and B) relative to each other while the rod-shaped component is being transported by the first roller system (A) through the first and second roller systems (A and B), to bend the rod-shaped component within a bending zone between the first and second roller systems (A and B), and increasing or reducing the forward driving movement produced by the driving rollers of the second roller system (B), to subject the rod-shaped component to a controlled tensile or compressive stress in the bending zone between the first and second roller systems (A and B) during the bending.

32. The method according to claim 31, wherein the driving of the rod-shaped component by the second roller system (B) is performed at an angle ($\alpha$) to the longitudinal axis of the rod-shaped component.

33. The method according to claim 31, wherein a torsional stress is superimposed in the bending zone between the first roller system (A) and the second roller system (B) by pivoting at least one of the first roller system (A) and the second roller system (B).

34. The method according to claim 31, wherein the rod-shaped component is twisted about the longitudinal axis by pivoting at least one of the first roller system (A) and the second roller system (B).

35. The device according to claim 19, wherein the rollers of the second roller system (B) are driven, and bearing surfaces of the rollers of the second roller system (B) are in frictional contact with the rod-shaped component.

36. The device according to claim 35, wherein the second roller system (B) is configured to superpose tensile stress on the component in a region of the bending zone between the first and second roller systems (A and B) by increasing forward driving movement of the second roller system (B), and the second roller system (B) is configured to superpose compressive stress on the component in a region of the bending zone between the first and second roller systems (A and B) by reducing forward driving movement of the second roller system (B).

37. The device according to claim 19, wherein the second roller system (B) is pivotable in at least a second plane oriented perpendicularly to the first plane with a rotation angle (β) being varied during the bending by moving the second roller system (B) such that the rollers of the second roller system (B) are pressed tangentially onto a component surface, whereby a torsional stress is superimposed on the bending zone between the first and second roller systems (A and B) for compensation of spring-back and elastic deformation.

38. A method for planar and spatial bending of a rod-shaped component having a longitudinal axis using a device having first and second roller systems (A and B) disposed along the longitudinal axis, wherein said first roller system (A) comprises a plurality of transport rollers and said second roller system (B) comprises a plurality of bending rollers, the method comprising steps of:

driving the rod-shaped component by the first roller system (A), by frictional engagement with said transport rollers, to insert the rod-shaped component into the second roller system (B) and to transport the rod-shaped component through the first and second roller systems (A and B);

moving the second roller system (B) in a transverse direction to the longitudinal axis, and thereby changing a position of the first and second roller systems (A and B) relative to each other while the rod-shaped component is being transported by the first roller system (A) through the first and second roller systems (A and B), to bend the rod-shaped component in a first plane within a bending zone between the first and second roller systems (A and B), and wherein, during the bending process, bending in at least one further plane is adjusted by pivoting the first roller system (A) relative to the second roller system (B) and about the longitudinal axis of the rod-shaped component.

* * * * *